US005976016A

United States Patent [19]

Moody et al.

[11] Patent Number: 5,976,016

[45] Date of Patent: Nov. 2, 1999

[54] MULTI-LINE SLOT MACHINE METHOD

[75] Inventors: Ernest W. Moody, Longmont; Michael Matanky, Boulder, both of Colo.

[73] Assignee: Ernest W. Moody, Las Vegas, Nev.

[ * ] Notice: This patent is subject to a terminal disclaimer.

[21] Appl. No.: 09/040,143

[22] Filed: Mar. 17, 1998

Related U.S. Application Data

[63] Continuation-in-part of application No. 08/495,952, Jun. 28, 1995, Pat. No. 5,531,448, application No. 08/755,174, Nov. 25, 1996, Pat. No. 5,732,950, and application No. 08/900,965, Jul. 25, 1997, Pat. No. 5,823,873

[60] Provisional application No. 60/019,879, Jun. 17, 1996.

[51] Int. Cl.[6] ..... A63F 9/22; G07F 17/34

[52] U.S. Cl. ..... 463/13; 273/292; 273/143 R; 463/20

[58] Field of Search ..... 273/143 R, 292; 463/13, 12, 20

[56] References Cited

U.S. PATENT DOCUMENTS 5,356,140 10/1994 Dabrowski et al. ..... 463/13
5,722,891 3/1998 Inoue ..... 463/20
5,725,428 3/1998 Achmuller ..... 463/20
5,823,873 10/1998 Moody ..... 463/13

*Primary Examiner*—Benjamin H. Layno
*Attorney, Agent, or Firm*—John Edward Roethel

[57] ABSTRACT

A player makes a wager for each pay line on a slot machine that the player wishes to play. On a first pay line of the slot machine, a first row of symbols is displayed to the player. The player selects none, one or more of the symbols from the first pay line as symbols to be held. The symbols that are held are duplicated from the first pay line into all of the other pay lines on which the player has wagered. Replacement symbols for the non-selected symbols are then randomly displayed on the first pay line for the symbols that were discarded. Additional symbols are also randomly displayed into all of the other pay lines wagered on by the player so that each pay line has the required number of symbols. The ranking of each pay line is determined by comparing the results of the displayed symbols to a pay table. The player is then paid for any winning pay lines based on the pay table and the amount of the player's wager.

4 Claims, 3 Drawing Sheets

MULTI-LINE SLOT MACHINE METHOD

CROSS-REFERENCE TO RELATED APPLICATIONS

This application is a Continuation-in-Part of Application Ser. No. 08/495,952, entitled "Poker-Style Card Game", filed Jun. 28, 1995, now U.S. Pat. No. 5,531,448, and is based on Provisional Application Ser. No. 60/019,879, entitled "Electronic Video Poker Games", filed Jun. 17, 1996, and is also a Continuation-in-Part of Application Ser. No. 08/755,174, entitled "Electronic Video Poker Games", filed Nov. 25, 1996, now U.S. Pat. No. 5,732,950, and is also a Continuation-in-Part of Application Ser. No. 08/900,965, entitled "Electronic Video Poker Games", filed Jul. 25, 1997, now U.S. Pat. No. 5,823,873.

BACKGROUND OF THE INVENTION

This invention relates primarily to electronic video gaming devices, and more particularly to electronic video slot machines that display multiple pay lines. While the present invention has many variations, the basic principle common to all of the variations is that a first set of slot machine symbols are shown to the player and the player must then decide which of these first symbols to hold and which to discard. The symbols held by the player are duplicated into other active pay lines. Replacement symbols are then displayed for those symbols which were discarded to complete each pay line. The invention can also be applied to live casino table games as well.

SUMMARY OF THE INVENTION

A player makes a wager for each pay line on a slot machine that the player wishes to play. On a first pay line of the slot machine, a first row of symbols is displayed to the player. The player selects none, one or more of the symbols from the first pay line as symbols to be held. The symbols that are held are duplicated from the first pay line into all of the other pay lines on which the player has wagered. Replacement symbols for the non-selected symbols are then randomly displayed on the first pay line for the symbols that were discarded. Additional symbols are also randomly displayed into all of the other pay lines wagered on by the player so that each pay line has the required number of symbols. The ranking of each pay line is determined by comparing the results of the displayed symbols to a pay table. The player is then paid for any winning pay lines based on the pay table and the amount of the player's wager.

DETAILED DESCRIPTION OF THE PREFERRED EMBODIMENTS

The present invention includes a variety of methods of play that can be programmed on an electronic video slot machine. Each electronic video slot machine is programmed to display multiple pay lines with each pay line displaying multiple symbols. Each pay line with its multiple symbols are displayed on a video screen to a player.

Initially, a row of symbols are first randomly selected and displayed on a single pay line. By manipulating the buttons on the gaming device or by using conventional touch screen technology, the player selects which of the initial symbols on the fist pay line the player wishes to hold and which symbols he wishes to discard. Symbols that are held by the player are the duplicated into all of the other pay lines that the player has wagered on thus allowing the player more chances to win.

Replacement symbols are then randomly selected and displayed for the discarded symbols and the outcome of the play of the game is determined.

Figure 1:
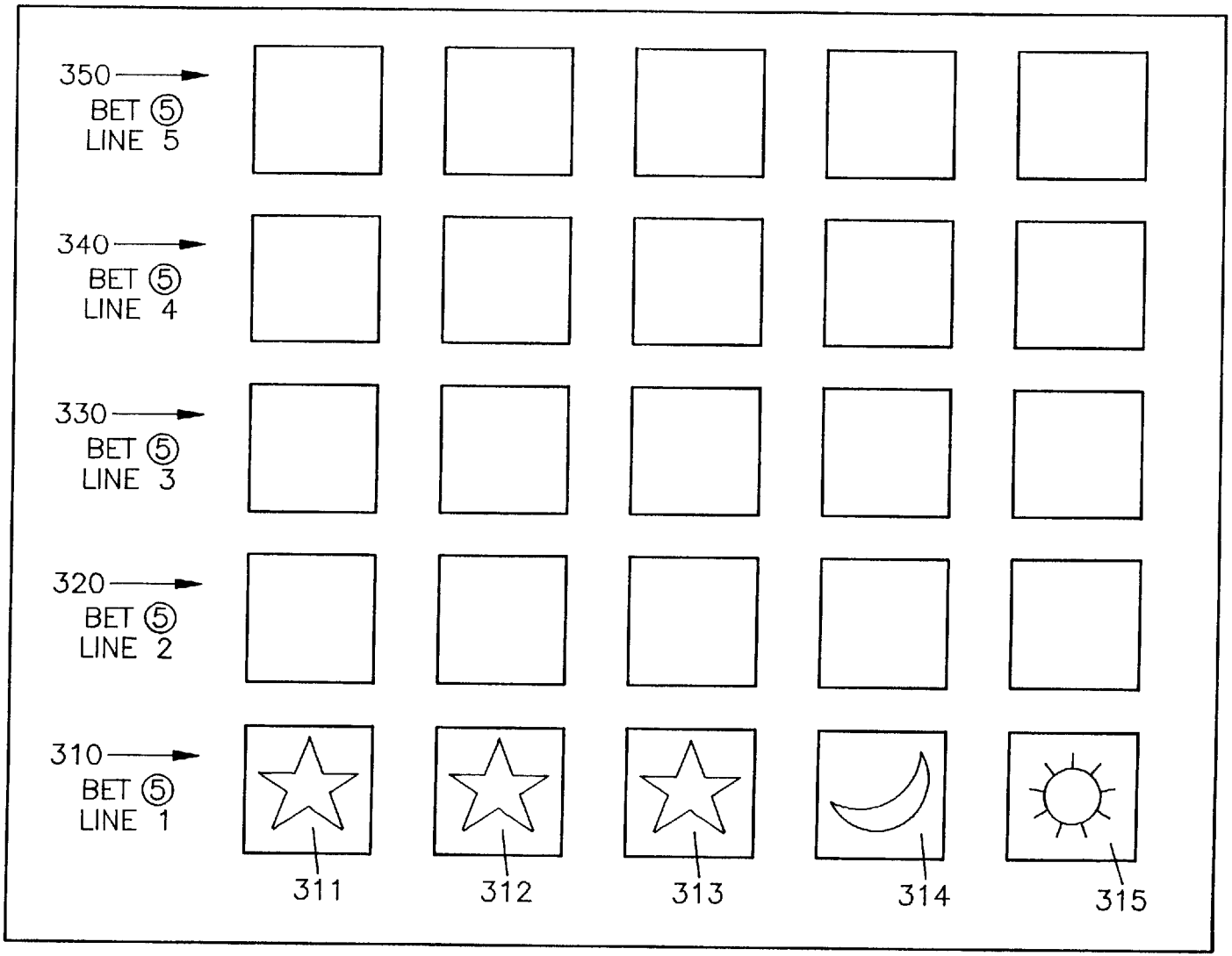
FIG. 1 shows the screen display for Version #1 of the present invention after the player has made his wagers and the initial symbols have been displayed on the first pay line.
Figure 2:
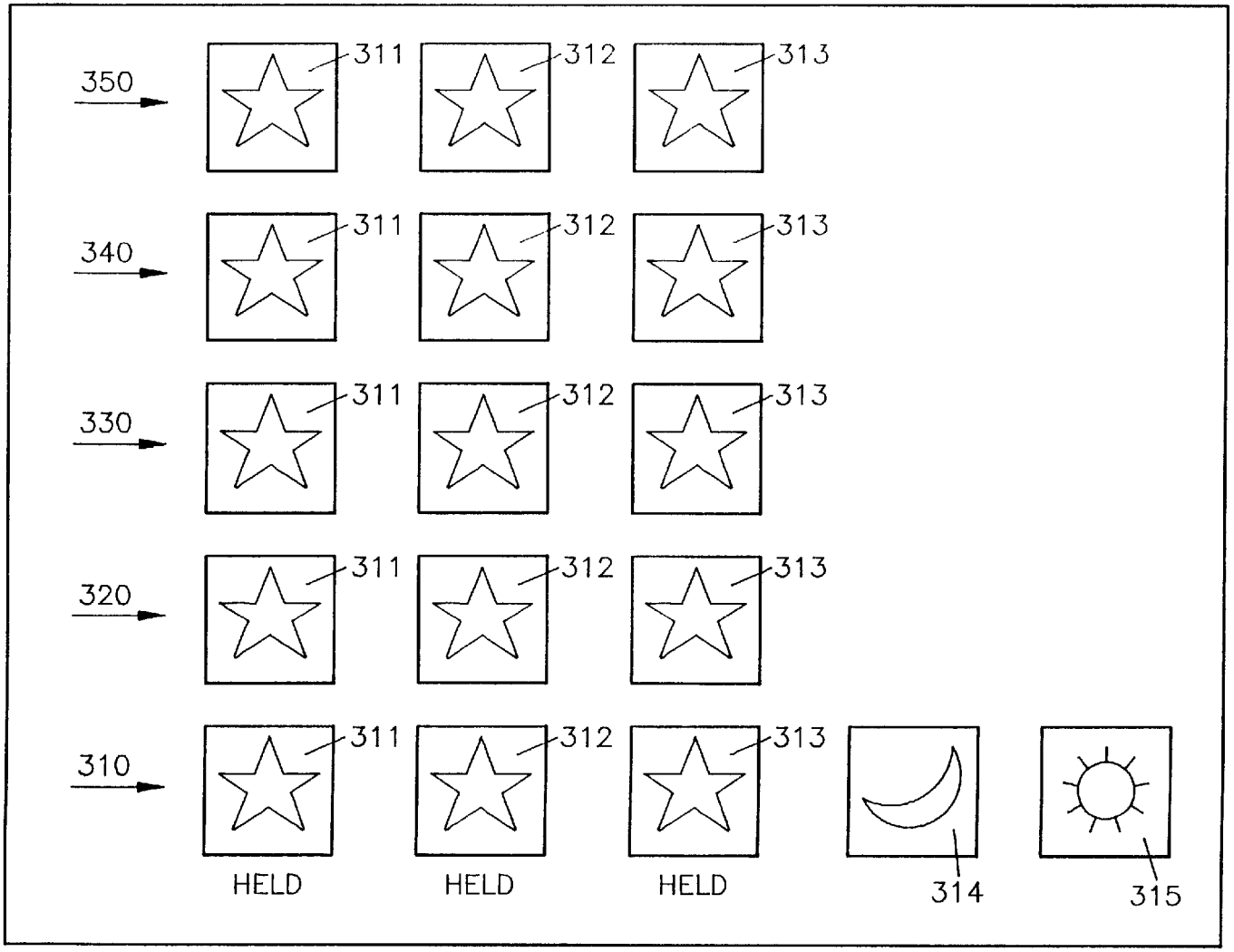
FIG. 2 shows the screen display for Version #1 of the present invention after the player has made his decision on which symbols to hold on the first pay line and these held symbols have been duplicated into the other pay lines.
Figure 3:
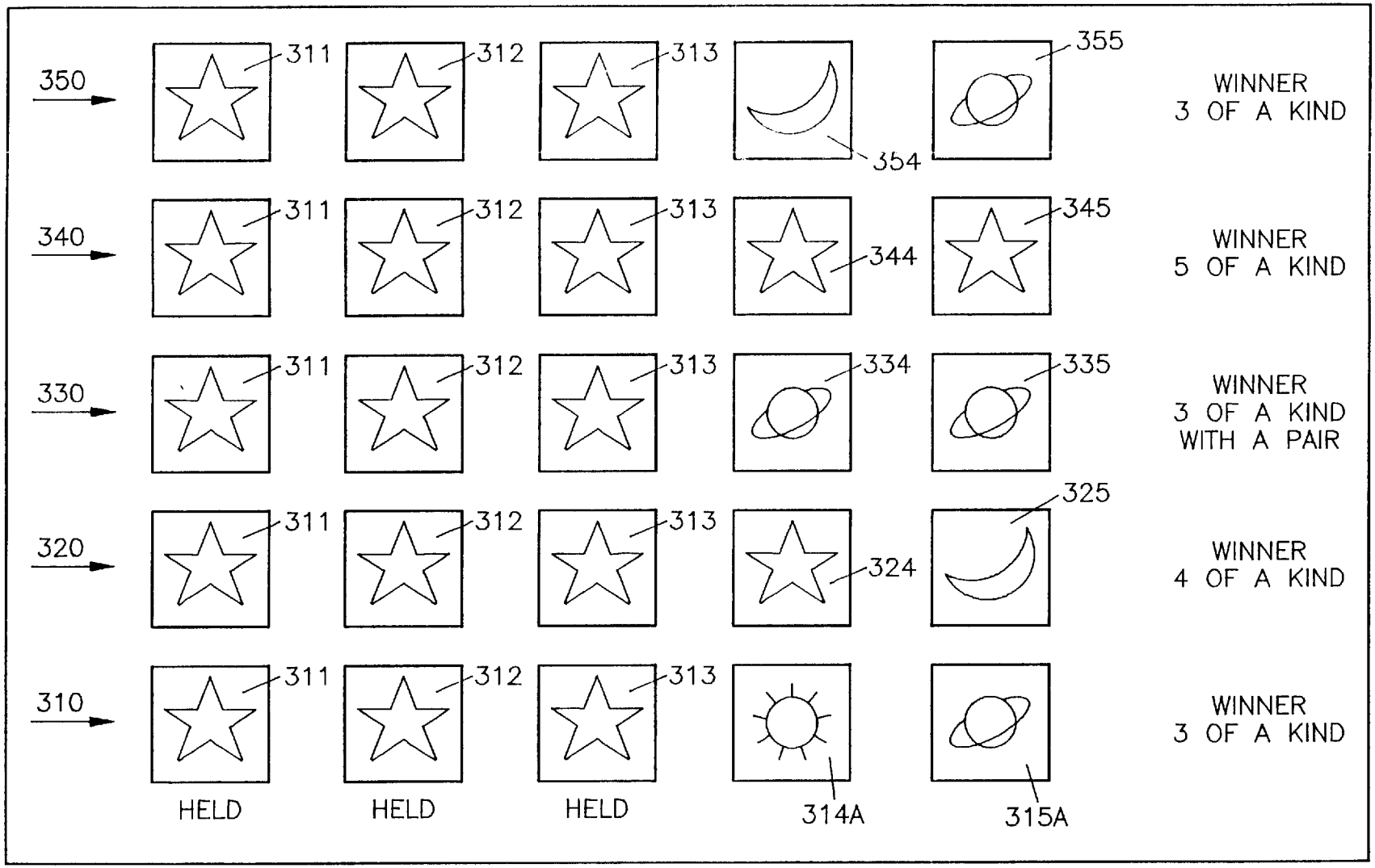
FIG. 3 shows the screen display for Version #1 of a result that could occur after replacement symbols have been randomly displayed into the pay lines on which the player has wagered.

Version #1 of the present invention is shown in FIGS. 1–3.

To commence the play of the game, the player makes one, two, three, four or five wagers: the first wager is on pay line 310, the second wager is on pay line 320, the third wager is on pay line 330, the forth wager is on pay line 340, and the fifth wager is on pay line 350. Thus, the player is wagering on one, two, three, four or five pay lines at a time. In the preferred embodiment of the present invention, the player is required to make a wager on the first pay line 310 and at least one of the other pay lines. Generally, the pay lines wagered on by the player would be activated in order from the bottom toward the top of the video screen display, but any other order of activation could be used.

In the preferred embodiment of this Version #1 of the present invention, the amount of the player's wager on each pay line would be the same. As shown in FIG. 1, the player has wagered by five credits on each pay line. Alternatively, the player could be allowed to make wagers of different amounts on each pay line.

After the player has selected the number of pay lines that the player wishes to play, a single pay line, e.g. pay line 310 at the bottom of the video screen, is provided with symbols which are randomly displayed into that pay line. This may be done as a video simulation of a reel slot machine or in any other suitable manner.

For example, as shown in FIG. 1, the initial video simulation of the spin of the reels on the bottom pay line 310 results in the following symbols being shown from left to right across the video screen: star 311, star 312, star 313, moon 314 and sun 315.

Once these initial symbols have been displayed on the bottom pay line 310, the player selects which of those symbols in the bottom pay line 310 that he wishes to hold. The player effects this selection by pressing buttons on a button panel on the gaming machine that correspond to each of the symbols or, if touch screen technology is used on the gaming machine, by simply pressing the symbols on the screen that the player wishes to hold. Each symbol that is held by the player from the bottom pay line 310 is then duplicated into the corresponding vertically aligned position in the other pay lines 320, 330, 340 and 350 which have been activated by the player by placing wagers on those pay lines.

As shown in FIG. 2, the player has decided to hold the three star symbols and each of these star symbols 311, 312 and 313 are duplicated into the other four pay lines 320, 330, 340 and 350 at the same vertically aligned position. In this example, the player has held star 311, star 312 and star 313 from the bottom pay line 310. Star 311 is duplicated in the same vertically aligned position in pay lines 320, 330, 340 and 350. Likewise, star 312 and star 313 are both duplicated in the same vertically aligned positions in pay lines 320, 330, 340, and 350.

The player then causes the gaming machine to display the other symbols for the other pay lines to complete each pay line. This can be done in any suitable manner such as having the player press a "SPIN" button on the button panel or, if touch screen technology is being used, by having the player press a "SPIN" panel on the gaming screen.

FIG. 3 shows an example of the completed play of the game after the player has held the desired symbols from the bottom pay line 310, after these held symbols have been duplicated into the other pay lines and after the player has activated the spin button to complete the other pay lines.

After the player is satisfied with his selection of replacement symbols and after the player has pressed the "SPIN" button, the two replacement symbols need to complete the bottom pay line 310 are randomly selected and displayed in the bottom pay line 310 and, in this example, are shown as sun 314A and planet 315A. Similarly, the symbols needed to complete pay line 320 are randomly selected and displayed in pay line 320 and, in this example, are shown as star 324 and moon 325. The symbols needed to complete pay line 330 are randomly selected and displayed in pay line 330 and, in this example, are shown as planet 334 and planet 335. The symbols needed to complete pay line 340 are randomly selected and displayed in pay line 340 and, in this example, are shown as star 344 and star 345. Finally, the symbols needed to complete pay line 350 are randomly selected and displayed in pay line 350 and, in this example, are shown as moon 354 and planet 355.

Each pay line is treated as a separate winning opportunity or separate game for payout purposes. Each pay line is evaluated based on the combination of the symbols displayed on that pay line. The player is paid based on the amount of his wager on each pay line depending on the combination of symbols achieved for that pay line. A pay table is provided and displayed to the player to show which winning symbol combinations pay which amounts.

Thus, the player has effectively played five pay lines or five games at once. The player could win on all five pay lines, could lose on all five pay lines or could win or lose on any combination thereof.

The number of symbols used in the method of play is not critical and is based on the probabilities desired to be employed in the game.

In the preferred embodiment of this invention using a pay line having five symbol locations, the method of play uses a two hundred fifty symbol set with twenty-five each of ten different symbols. For example, out of the total of two hundred fifty symbols, twenty-five of the symbols are stars, twenty-five of the symbols are suns, twenty-five of the symbols are moons, twenty-five of the symbols are planets and so on. A common theme can be used for the symbols, and in this case, the remaining six symbols could be an earth symbol, a comet symbol, an alien symbol, a flying saucer symbol, a spaceman symbol and a rocket ship symbol. Any suitable symbols made be used including the traditional fruit symbols that have previously been used in reel slot machines.

Each subset of twenty-five symbols consists of five specimens of the same symbol in five different colors: e.g. five red stars, five blue stars, five green stars, five yellow stars and five orange stars. This results in a two-hundred fifty symbol set.

While this is the preferred embodiment, other combinations of symbol sets can be used. The symbols set can have more or less than two hundred fifty total symbols and the symbol set can have more or less than ten types of symbols. More or less than five colors can be used or colors can be eliminated entirely.

Any suitable pay table can be used; with the winning amounts and symbol combinations being based on the mathematical return desired to be provided on the gaming machine. For example, a typical pay table is shown in Table 1:

TABLE 1

| WINNING SYMBOL COMBINATION | PAYOUT |
|---|---|
| One Pair (same color) | 1 for 1 |
| Two Pairs | 1 for 1 |
| Two Pairs (same color) | 1 to 1 |
| Three of a kind | 2 to 1 |
| Three of a kind (same color) | 3 to 1 |
| Five different symbols all different colors | 4 to 1 |
| Five symbols (same color) | 6 to 1 |
| Three of a kind and a pair | 7 to 1 |
| Three of a kind and a pair (same color) | 10 to 1 |
| Four of a kind | 25 to 1 |
| Four of a kind (same color) | 50 to 1 |
| Five of a kind | 500 to 1 |
| Five of a kind (same color) | 10,000 to 1 |

One or more symbols may also be designated as wild symbols. Wild symbols increase the possibility of player achieving winning combinations and the pay table should be adjusted to reflect that wild symbols are in use.

If a player holds less than five symbols from the bottom pay line 310, each pay line will probably have different replacement symbols since the replacement symbols are randomly selected. This results in the player having the possibility of achieving various winning combinations in each of the pay lines.

In the preferred embodiment of this Version #1 of the present invention, each pay line uses its own distinct symbol set from which the symbols are selected. After the initial five symbols are selected from the first symbol set, the five initial symbols shown in the first pay line are omitted from each of the other symbols sets so as to provide the same symbol pool for the replacement symbols for each of the other pay lines. This would allow the possibility of the player, for example, to theoretically achieve five of the same winning combinations in each of the five pay lines.

Special bonus payouts can be added if the player achieves five high ranking combinations at the same time. These bonus payouts could be fixed amounts or progressive payouts. For example, the player could win a progressive payout for achieving a five of a kind on each of the five pay lines at the same time.

In another embodiment of this Version #1 of the present invention, all of the symbols used for both the bottom pay line 310 and the other pay lines 320, 330, 340 and 350 are randomly selected from the same symbol set, e.g. the two hundred fifty symbol set described above. In this alternative, each of the five pay lines will receive different replacement symbols from the symbol set for those symbols that are discarded. For example, if a player holds less than five symbols from the bottom pay line 310, each pay line will receive different replacement symbols so that player has the possibility of achieving various winning combinations.

In the preferred method of displaying the present invention in which all five pay lines of symbols are displayed face up with the same symbols shown vertically aligned in each pay line, when the player selects which symbol to hold from one pay line, the same symbols in the other four pay lines are automatically held.

The number of pay lines employed in the present invention is also not critical. More or less than five pay lines can be used.

For example, if the number of pay lines is reduced from five pay lines to only two pay lines, the player would make two wagers to play the two pay lines and select the symbols initially dealt in the bottom pay line that would then be duplicated into the other pay line. Replacement symbols would be provided to complete the empty locations in each of the two pay lines and winning and losing symbol combinations would be determined in the same manner as described above with reference to the five pay lines. A suitable pay table would be provided for this two pay line version of the present invention.

Likewise, the method of play could also be modified by decreasing the number of pay lines from five to three pay lines or four pay lines. Again if three or four pay lines are used, the method of play would be the same as that described above with reference to the five pay line version of the present invention.

Version #2. This version #2 of the present invention only displays one pay line at a time on the video display screen. Some existing video screen displays may use monitors that are too small to show five pay lines. In order to adopt the present invention to these smaller video monitors often used in video poker gaming machines, the display of the play of this method can be modified. The player would initially make a multiple coin or credit wager representing the number of pay lines that the player wishes to play during that round of the game. The minimum number of coins or credits wagered would be two with the maximum being any number desired. A first pay line of five symbols would initially be dealt to the player. The player would select which of five symbols, if any, the player wishes to hold and then replacement symbols would be randomly selected and displayed for the discarded symbols. The winning or losing outcome of this first pay line would then be determined.

For the second pay line, the symbols held by the player from the first pay line would then be redisplayed on the video screen and additional symbols would be randomly selected and displayed to complete the player's second pay line. Again, the winning or losing outcome of this second pay line would be determined. The steps of re-displaying the held symbols from the first pay line and then randomly selecting and displaying symbols to complete the pay line would be repeated for each wager made by the player until the total number of pay lines originally wagered by the player is completed.

In this seriatim alternative method of play, each pay line is completed by using a separate set of symbols (which have the first five symbols removed therefrom so as to eliminate the possibility of duplicated symbols being dealt as replacement symbols). Alternatively, a single set of symbols can be used as the source for both the initial five symbols and the additional symbols used to complete each of the multiple pay lines.

Version #3: In this version #3 of the present invention, the initial five symbols from the first pay line are duplicated into all five pay lines at the time of the initially selection of the symbols. Thus the screen display shows twenty-five symbols with each pay line having the same five symbols. The player selects which symbols he wishes to hold in each column of a pay line and that symbol selected is held in each corresponding vertically aligned column in each pay line. After the player has completed this selection, the player presses the "deal" button and replacement symbols are dealt and displayed in each pay line. Each pay line is then analyzed for winning symbol combinations and the player wins according to the pay table based on the amount wagered for each pay line. The player will have the same held symbols in each pay line and new symbols in each pay line for those symbols that were discarded. The player again has the possibility of making different winning combinations in each pay line.

The method of this version of the present invention can be played using any number of sets of symbols, but the preferred embodiment is to utilize a set of symbols containing two hundred fifty symbols with twenty-five each of ten different symbol types. Each twenty-five symbol subset is further divided into five symbols in each of five different colors.

One modification of the present invention that can be applied to either of these versions involves the addition of a bonus round which the player earns based on achieving certain pay line combinations. If the player qualifies for a bonus round, the player is dealt five symbols at random from the total symbol set. Each symbol is initially displayed on the video screen face down and then are turned over one at a time. The player is paid if this bonus pay line symbol combination qualifies for the bonus award pay table. A jackpot, which is either a fixed amount or a progressive jackpot, can be paid for five symbols of the same kind or five symbols of the same kind and color.

Other modifications can be made to either version of the present invention. For example, as described above, each pay line in the preferred embodiments of the present invention has five symbol locations. However, more or less than five symbol locations can also be used. Preferably the number of symbol locations in each pay line should not be less than three so as to provide enough locations to create mathematical combinations of sufficient numbers to allow reasonable winning payout amounts.

The method of the present invention can also be modified to be played on a live gaming table incorporating one or more video display screens. In this embodiment, the wagers made by each player are collected by a dealer stationed at the gaming table. The dealer then activates each video screen display and each player selects which symbols to hold. The dealer then activates the video screen display to cause replacement symbols to be displayed to complete each pay line. If a player achieves a winning combination of symbols on any pay line, the dealer pays the player his winning amount.

The method of the present invention can also be applied to mechanical reel slot machines which have multiple reel mechanisms. For example, IGT, Inc. of Reno, Nev. markets a multiple reel mechanical slot machine apparatus known as the TOTEM POLE™ gaming machine. This gaming machine has three separate mechanical slot machines reel assemblies stacked vertically. Using this apparatus, the present invention can be practiced by initially displaying the symbols on the pay line of the lowest mechanical reel. The player can then select which of the symbols he wishes to hold from the symbols displayed. The symbols held by the player are then duplicated onto the mechanical display of the other two vertically aligned reel assemblies. Each of the mechanical reel assemblies are then caused to respin by the player and the pay lines out each mechanical reel display are completed. Winning payouts are paid to the player.

While the invention has been illustrated with respect to several specific embodiments thereof, these embodiments should be considered as illustrative rather than limiting.

Various modifications and additions may be made and will be apparent to those skilled in the art. Accordingly, the invention should not be limited by the foregoing description, but rather should be defined only by the following claims.

What is claimed is:

1. A method of playing a gaming device comprising:

a) randomly selecting and displaying a first pay line of at least three symbols;

b) selecting none, one or more of the symbols from the first pay line as symbols to be held;

c) duplicating the symbols selected to be held from the first pay line into at least a second pay line;

d) discarding from the first pay line the symbols that were not selected to be held and replacing each of those symbols with a new symbol which is randomly selected;

e) completing the second pay line and any additional pay lines, if any, to have at least three symbols by randomly selecting and displaying additional symbols into the second pay line and any subsequent pay lines;

f) determining the symbol ranking of the resulting symbols of the first pay line, the second pay line and any additional pay lines.

2. The method of claim 1 including the steps of:

a) a player making a first wager on the first pay line, a second wager on the second pay line and additional wagers on any subsequent pay lines.

b) paying the player a preestablished amount based on the amount of the first wager if the resulting symbols of the first pay line comprise a predetermined winning ranking;

c) paying the player a preestablished amount based on the amount of the second wager and any additional wagers if the resulting symbols of the second pay line or any additional pay lines comprise a predetermined winning ranking.

3. The method of claim 1 in which each pay line has five symbols.

4. The method of claim 1 in which there are five pay lines.

* * * * *